US005913289A

United States Patent [19]

Gerstmann

[11] Patent Number: 5,913,289

[45] Date of Patent: Jun. 22, 1999

[54] FIRETUBE HEAT EXCHANGER WITH CORRUGATED INTERNAL FINS

[75] Inventor: Joseph Gerstmann, Framingham, Mass.

[73] Assignee: Gas Research Institute, Chicago, Ill.

[21] Appl. No.: 09/093,429

[22] Filed: Jun. 8, 1998

[51] Int. Cl.[6] ..... F22B 23/06

[52] U.S. Cl. ..... 122/367.3; 165/154

[58] Field of Search ..... 122/367.3; 126/99 C, 126/110 B, 99 A; 165/80.3, 154, 183

[56] References Cited

U.S. PATENT DOCUMENTS

| | | | |
|---|---|---|---|
| 3,587,531 | 6/1971 | Magnuson | 122/367.3 |
| 3,881,547 | 5/1975 | Lavering | 165/183 |
| 4,163,474 | 8/1979 | MacDonald et al. . | |
| 4,554,969 | 11/1985 | Carnavos . | |
| 4,589,374 | 5/1986 | Farina | 122/367.3 |
| 5,782,208 | 7/1998 | Lackstrom et al. | 122/367.3 |
| 5,826,646 | 10/1998 | Bae et al. | 165/183 |

FOREIGN PATENT DOCUMENTS

| | | | |
|---|---|---|---|
| 1168929 | 11/1964 | Germany | 122/367.3 |

*Primary Examiner*—Teresa Walberg
*Assistant Examiner*—Gregory A. Wilson
*Attorney, Agent, or Firm*—Pauley Petersen Kinne & Fejer

[57] ABSTRACT

A firetube heat exchanger having a tubular member with a fluid inlet end and a fluid outlet end and a plurality of axially aligned fins secured to the interior wall of the tubular member. The axially aligned fins are constructed of at least one sheet of corrugated sheet metal, thereby providing fins having an upper side facing the interior of the tubular member and an underside facing the interior wall of the tubular member. Various embodiments include elements for controlling the flow of heat exchange fluid, typically products of combustion, on the upper side and the underside of the axially aligned fins.

10 Claims, 2 Drawing Sheets

FIRETUBE HEAT EXCHANGER WITH CORRUGATED INTERNAL FINS

BACKGROUND OF THE INVENTION

1. Field of the Invention

This invention relates to a firetube heater for use in fired heaters including boilers and vapor generators, which provides a large heat output in a relatively short, small-diameter tube. More particularly, this invention relates to a firetube heat exchanger suitable for use in such fired heaters having corrugated internal fins for promoting the transfer of heat from the products of combustion disposed within the firetube through the firetube walls and into the medium to be heated.

2. Description of Prior Art

Internally finned heat exchanger tubes are known in the art. See, for example, U.S. Pat. No. 4,554,969 which teaches a coaxial finned tube heat exchanger. U.S. Pat. No. 4,163,474 teaches an internally finned tube heat exchanger having fins in the form of a series of elongated V-shaped strips, formed in accordance with one embodiment by a corrugated metal. The fins are provided with holes to permit transverse flow of fluid through each fin as the fluid also travels longitudinally along the tube. One problem with this design, particularly when used with a high temperature heat exchange fluid, such as products of combustion, is the tendency of the fins to overheat at the point where the fluid is introduced into the tube beneath the fins. This is due to the very high heat transfer coefficient present at the leading edges of the fins, the point at which the fluid is introduced beneath the fins.

SUMMARY OF THE INVENTION

It is one object of this invention to provide a firetube heat exchanger suitable for use in fired heaters such as boilers and vapor generators that provides a large heat output in a relatively short, small diameter tube.

It is another object of this invention to provide a firetube heat exchanger having better uniformity of heat distribution and transfer over comparable known heat exchangers.

These and other objects of this invention are achieved by a firetube heat exchanger comprising a tubular member having a fluid inlet end and a fluid outlet end and a plurality of axially aligned fins secured to an interior wall of the tubular member. The axially aligned fins are preferably constructed of corrugated sheet metal whereby the upper side of the axially aligned fins faces the interior of the tubular member and the underside of the axially aligned fins faces the interior wall of the tubular member. A burner, such as a cylindrical Meker-type burner, is disposed at the fluid inlet end of the tubular member, which burner provides hot products of combustion from the combustion of a fuel/oxidant mixture to the interior of the tubular member.

It will be apparent to those skilled in the art that the temperature of the products of combustion flowing through the tubular member will be the highest at the fluid inlet end of the tubular member and will cool as the products of combustion traverse the length of the tubular member to the fluid outlet end. Thus, care must be taken to avoid overheating of the axially aligned fins, or the portions thereof, proximate the combustion products inlet end. One solution to this overheating problem is to restrict the flow of combustion products such that they are unable to be directed at the leading edge of the axially aligned fins to the underside thereof. This is accomplished, in accordance with one embodiment of this invention, by a blocking member disposed at the end of the axially aligned fins facing the fluid inlet end of the heat exchanger, that is the leading edges of the fins, and blocking fluid communication from the fluid inlet end of the firetube heat exchanger, passed the leading edges, and to the underside of the corrugated sheet metal.

To enable the combustion products to flow to the underside of the axially aligned fins, slots are provided at the base of the fins. Disposition of the slots at the base of the fins is critical for minimizing the conduction distance for heat in the combustion products to the cooler wall of the tubular member. The slots are preferably distributed over at least about 25% of the length of said axially aligned fins so that all of the combustion products do not enter the underside of the fins all at one time. Preferably, the slots are sized to permit about one-half of the hot combustion products to pass through the slots to the underside of the fins with the remainder being forced to flow over upper side of the fins by the presence of a core plug.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
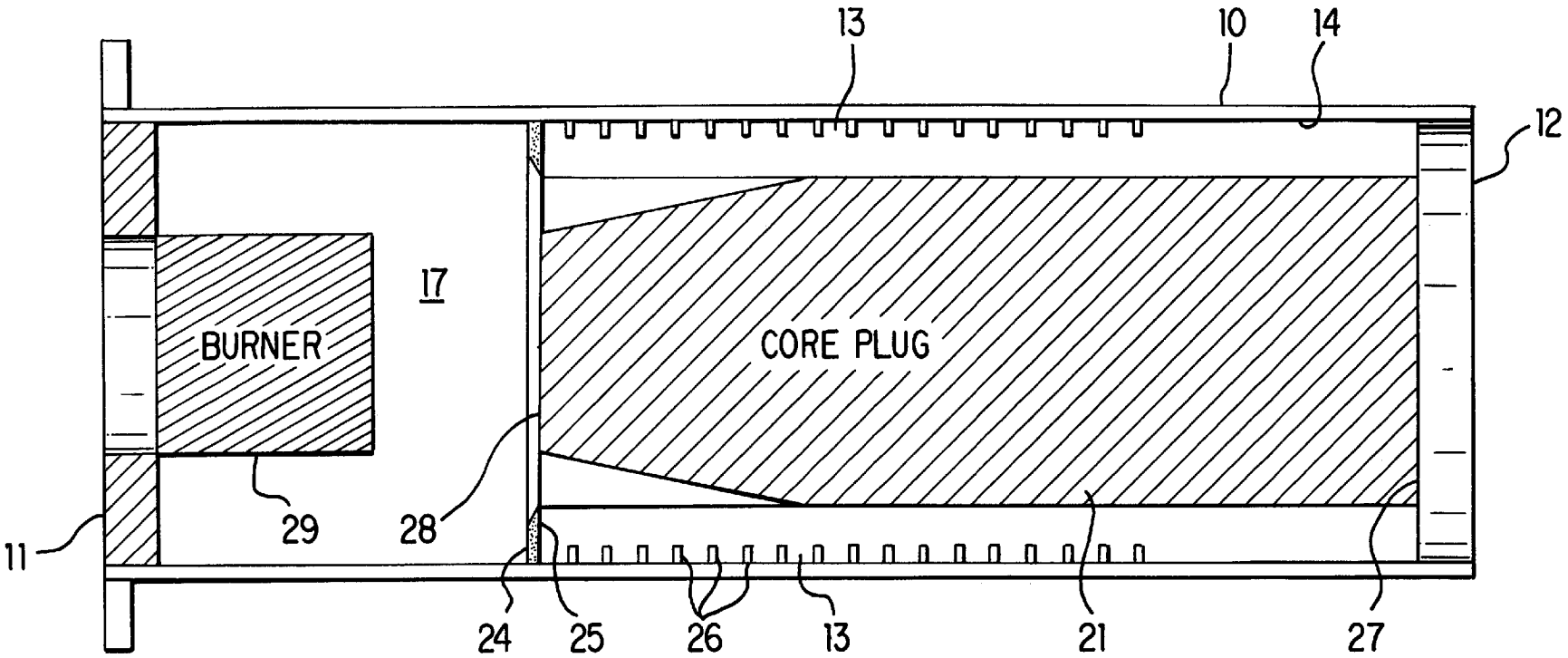
FIG. 1 is a cross-sectional side view of a firetube heat exchanger/heater in accordance with one embodiment of this invention.

A firetube heat exchanger suitable for use in boilers, vapor generators, and other fired heaters which provides large heat output in a relatively short, small-diameter tube in accordance with one embodiment of this invention is shown in FIG. 1. The firetube heat exchanger/heater comprises a steel tubular member, or firetube, 10 jacketed by a fluid to be heated (not shown) having fluid inlet end 11 and fluid outlet end 12 for input and output of a heat transfer medium, in particular, products of combustion from, for example, burner 29 disposed at fluid inlet end 11 of tubular member 10. Burner 29 may be any of a number of known burners suitable for use in firetube heaters, but in accordance with the embodiment shown is a cylindrical perforated sheet metal burner which is supplied with a gas/air mixture which burns on the outside of the perforated cylinder. Secured to interior wall 14 of tubular member 10 are a plurality of axially aligned fins 13, which fins substantially increase the available surface area for transfer of heat from the combustion products to the fluid to be heated over the surface area of the bare interior wall 14 of tubular member 10.

In accordance with one particularly preferred embodiment of this invention, axially aligned fins 13 are constructed of at least one sheet of corrugated sheet metal secured, for example, by brazing to the interior wall 14 of tubular member 10. When thus formed from corrugated sheet metal, axially aligned fins 13 have an "upper" side which faces toward the center line of tubular member 10 and an "underside" which faces interior wall 14 of tubular member 10.

As previously stated, products of combustion produced by burner 29 are hottest toward fluid inlet end 11 of tubular member 10 and cool as they flow through tubular member 10 toward fluid outlet end 12 due to the transfer of heat to the fluid surrounding tubular member 10. To prevent fin end 25, or leading edge, of axially aligned fins 13 closest to fluid inlet end 11 from overheating, blocking member 24, preferably in the form of a ring flange, abuts fin end 25 of axially aligned fins 13 formed by the at least one sheet of corrugated sheet metal so as to block fluid communication between fluid inlet end 11 and the underside of axially aligned fins 13 at fin end 25, thereby preventing the hot products of combustion from initiating flow through the underside of axially aligned fins 13 at fin end 25 and the otherwise resulting overheating of fin end 25. This construction permits the gases to flow only over the upper side of axially aligned fins 13 proximate fin end 25 when they may be excessively hot.

Figure 2:
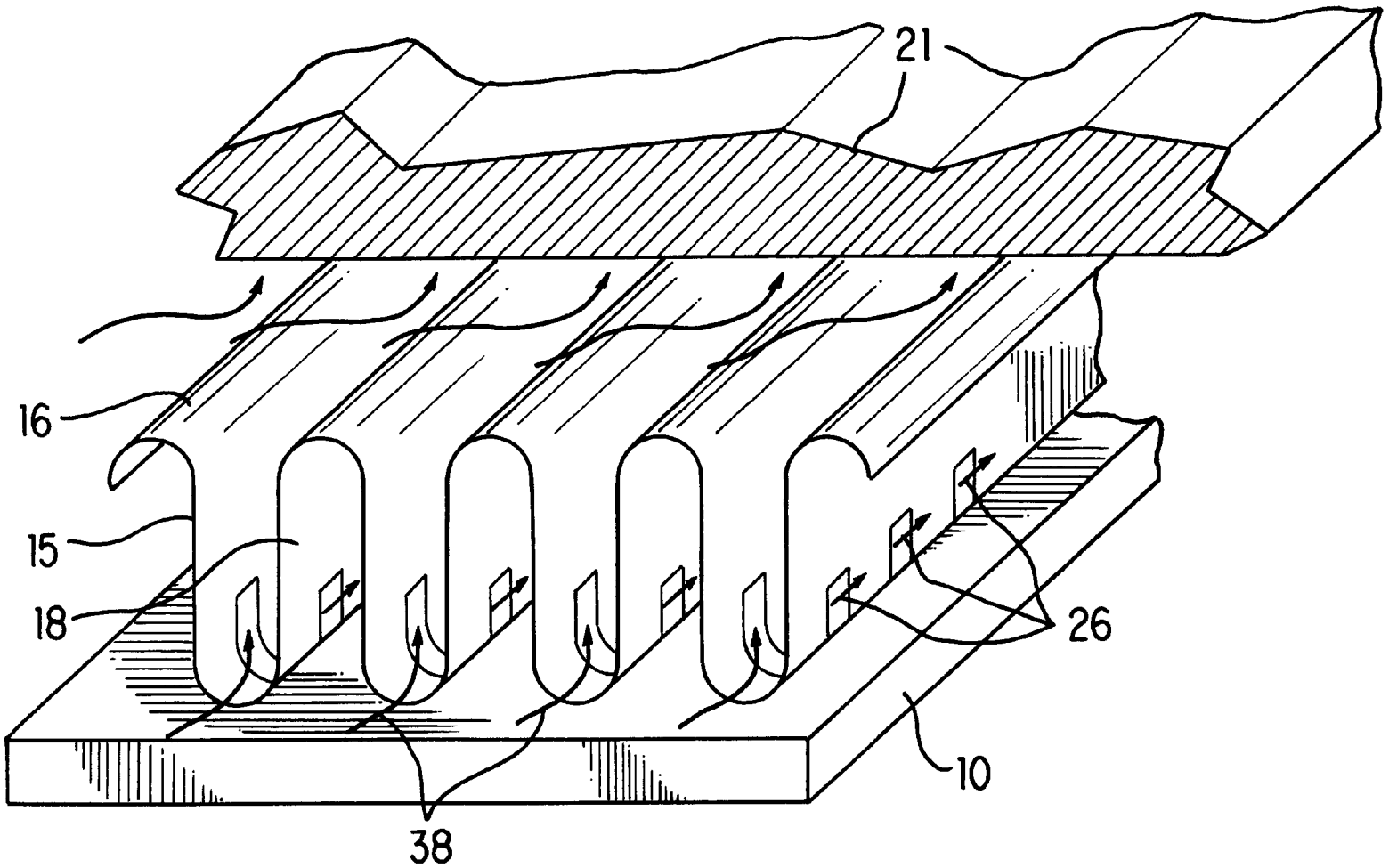
FIG. 2 is a partial perspective view from the leading edge of the axially aligned fins of the firetube heat exchanger in accordance with one embodiment of this invention.

A plurality of slots 26 are formed at the base of axially aligned fins 13 near the interior wall 14 of tubular member 10. Because the leading edge 25 of axially aligned fins 13 which would otherwise permit gases to enter the underside of axially aligned fins 13 is blocked off by a ring flange 24 which is brazed, or otherwise secured, to interior wall 14 of tubular member 10, hot products of combustion are forced to enter the underside of axially aligned fins 13 through slots 26 which are well cooled by the conduction to the nearby interior wall 14 of tubular member 10. This flow pattern is better shown in FIG. 2 where gases can be seen directed through slots 26 as indicated by arrows 38 to underside 18 of corrugated sheet metal 15. To further control the uniformity of temperature of the hot gases entering the underside of axially aligned fins 13, slots 26 are distributed over a distance of several inches so that all of the hot gases do not enter under the axially aligned fins all at once. These slots 26 are sized to allow approximately half of the hot gases to pass through the slots and under the axially aligned fins with the remainder of the hot gases being forced to flow over the axially aligned fins by the presence of core plug 21.

Core plug 21, made of a heat resistant material, is disposed in the tubular member interior 17 and contacts the upper side of each of axially aligned fins 13. Core plug 21 thus forces a portion of the products of combustion from burner 29 to flow in between the corrugations which form axially aligned fins 13, thereby increasing the velocity of the products of combustion. Preferably, core plug 21 is disposed at an axial position within tubular member 10 where the products of combustion have cooled sufficiently such that their increased velocity does not overheat the fins.

In the preferred embodiment shown in FIG. 1, the height of axially aligned fins 13 is about ½ inch. Using 0.019 inch thick sheet metal made of 409 stainless steel with four corrugations per inch, producing eight fins per inch, the embodiment shown in FIG. 1 is capable of a heat input of about 60,000 Btu/hour in a 4 inch diameter by 20 inch long firetube, with a gross thermal efficiency of about 80%. The eight axially aligned fins per inch are provided with slots of 0.08 inches wide and deep and spaced every ⅜ inch for a length of approximately 10 inches. In accordance with one embodiment of the firetube heat exchanger of this invention, core plug 21 is tapered, as shown in FIG. 1, to form a truncated cone having a larger diameter base end 27 and a smaller diameter tip end 28. Smaller diameter tip end 28 is aligned with leading edge 25 of axially aligned fins 13. Thus formed, core plug 21 gradually forces hot gases generated by burner 29 into the spaces between the upper side of axially aligned fins 13, thereby providing more uniformity in heat transfer along the length of the firetube heat exchanger. It will be apparent to those skilled in the art that smaller diameter tip end 28 of core plug 21 may be aligned upstream or downstream of leading edge 25 of axially aligned fins 13 as necessary to obtain a desired heat transfer profile.

In a firetube heating device having a firetube heater comprising a tubular member having a fluid inlet end and a fluid outlet end and a burner disposed at the fluid inlet end for providing heat to the tubular member interior, the tubular member being surrounded by a fluid to be heated, the method of heating the fluid in accordance with this invention comprises the steps of burning a fuel/oxidant mixture with the burner to form products of combustion and contacting a plurality of axially aligned fins secured to an interior wall of the tubular member, which axially aligned fins are constructed of at least one sheet of corrugated sheet metal and have an upper side facing the tubular member interior and an underside facing the interior wall of the tubular member, with the products of combustion. As a result, heat in the products of combustion is transferred through the axially aligned fins to the tubular member and into the fluid surrounding the tubular member. The products of combustion are directed initially to contact the upper side of the axially aligned fins by a blocking member disposed at the fin end of the axially aligned fins facing the fluid inlet end, which blocking member closes off a fluid communication between the burner and the underside of the axially aligned fins at the fin end.

In accordance with one embodiment, a core plug is disposed in the tubular member and contacts the upper side of the axially aligned fins. At least one of the axially aligned fins forms at least one slot at a fin base proximate the interior wall of the tubular member whereby fluid communication is established between the burner and the underside of the axially aligned fins. As a result, the products of combustion are directed to the underside of the axially aligned fins through at least one slot.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A firetube heater comprising:

a tubular member having a fluid inlet end and a fluid outlet end;

a burner secured to said fluid inlet end of said tubular member;

a plurality of axially aligned fins disposed at a distance longitudinally from said burner secured to an interior wall of said tubular member, said axially aligned fins being constructed of at least one sheet of corrugated sheet metal and having an upper side facing a tubular member interior and an underside facing said interior wall and forming at least one slot at a fin base of at least one of said axially aligned fins proximate said interior tube wall, said at least one slot providing fluid communication between said fluid inlet end and said underside of said at least one axially aligned fin; and a blocking member disposed at a fin end of said axially aligned fins facing said fluid inlet end and blocking fluid communication through said fluid inlet end to said underside.

2. A firetube heater in accordance with claim 1 further comprising a core plug disposed in said tubular member and contacting said upper side of each of said fins.

3. A firetube heater in accordance with claim 2, wherein said core plug is a truncated cone having a larger diameter base end and a smaller diameter tip end, said smaller diameter tip end being oriented toward said fluid inlet end.

4. In a firetube heater for use in a heating device, said firetube heater comprising a tubular member having a fluid inlet end and a fluid outlet end and a burner disposed at said fluid inlet end for providing heat to a tubular member interior of said tubular member, the improvement comprising:

a plurality of axially aligned fins disposed at a distance longitudinally from said burner secured to an interior wall of said tubular member, said axially aligned fins being constructed of at least one sheet of corrugated sheet metal and having an upper side facing a tubular member interior and an underside facing said interior wall and forming at least one slot at a fin base of at least one of said axially aligned fins proximate said interior tube wall, said at least one slot providing fluid communication between said fluid inlet end and said underside of said at least one axially aligned fin; and a blocking member disposed at a fin end of said axially aligned fins facing said fluid inlet end and blocking fluid communication through said fluid inlet end to said underside.

5. A firetube heater in accordance with claim 4 further comprising a core plug disposed in said tubular member and contacting said upper side of said fins.

6. A firetube heater in accordance with claim 5, wherein said core plug is a truncated cone having a larger diameter base end and a smaller diameter tip end, said smaller diameter tip end being oriented toward said fluid inlet end and aligned with a leading edge of said axially aligned fins.

7. In a firetube heating device having a firetube heater comprising a tubular member having a fluid inlet end and a fluid outlet end and a burner disposed at said fluid inlet end for providing heat to a tubular member interior of said tubular member, said tubular member being surrounded by a fluid to be heated, a method of heating said fluid comprising the steps of:

burning a fuel/oxidant mixture with said burner, forming products of combustion; and contacting a plurality of axially aligned fins secured to an interior wall of said tubular member at a distance longitudinally from said burner, said axially aligned fins being constructed of at least one sheet of corrugated sheet metal and have an upper side facing said tubular member interior and an underside facing said interior wall, with said products of combustion, whereby heat in said products of combustion is transferred through said axially aligned fins to said tubular member and into said fluid, said products of combustion being directed to contact said upper side of said axially aligned fins by a blocking member disposed at a fin end facing said fluid inlet end and blocking fluid communication between said burner and said underside of said axially aligned fins through said fin end.

8. A method in accordance with claim 7, wherein said products of combustion are directed to said underside of said axially aligned fins through at least one slot formed by at least one of said axially aligned fins at a fin base proximate said interior wall.

9. A method in accordance with claim 7, wherein said products of combustion are guided toward said axially aligned fins by a core plug disposed in said tubular member and contacting said upper side of said axially aligned fins.

10. A method in accordance with claim 9, wherein said core plug is a truncated cone having a larger diameter base end and a smaller diameter tip end, said smaller diameter tip end being oriented toward said fluid inlet end and aligned with a leading edge of said higher height fins, whereby said products of combustion are gradually directed toward said axially aligned fins.

* * * * *